US009802070B2

(12) United States Patent
Wehr

(10) Patent No.: US 9,802,070 B2
(45) Date of Patent: Oct. 31, 2017

(54) VEHICLE ACCESSORY SUPPORT ASSEMBLY

(71) Applicant: Simon David Gray Wehr, San Clemente, CA (US)

(72) Inventor: Simon David Gray Wehr, San Clemente, CA (US)

( * ) Notice: Subject to any disclaimer, the term of this patent is extended or adjusted under 35 U.S.C. 154(b) by 18 days.

(21) Appl. No.: 15/094,951

(22) Filed: Apr. 8, 2016

(65) Prior Publication Data

US 2016/0297373 A1 Oct. 13, 2016

Related U.S. Application Data

(60) Provisional application No. 62/144,836, filed on Apr. 8, 2015.

(51) Int. Cl.
*A62C 13/78* (2006.01)
*A62C 3/07* (2006.01)

(52) U.S. Cl.
CPC ..... *A62C 13/78* (2013.01); *A62C 3/07* (2013.01)

(58) Field of Classification Search
CPC ..... A62C 3/07; A62C 13/78
USPC ..... 224/275, 547, 550, 555
See application file for complete search history.

(56) References Cited

U.S. PATENT DOCUMENTS 2,583,806 A * 1/1952 Batzle ..... A47C 7/64 224/275
5,129,563 A * 7/1992 Dillon ..... B60R 7/14 224/275
5,415,430 A * 5/1995 Valasin ..... B60R 22/22 280/801.1
5,833,101 A * 11/1998 Watkins ..... B60R 11/04 224/275
6,116,485 A * 9/2000 Watkins ..... B60R 11/04 224/275
6,499,786 B2 * 12/2002 Takahashi ..... B60N 2/28 280/801.1
6,736,438 B1 * 5/2004 Wieclawski ..... B60N 2/4673 224/275
7,131,693 B2 * 11/2006 Smallwood ..... B60N 2/289 224/275
7,225,956 B2 * 6/2007 Lien ..... B62J 9/006 224/275
7,431,339 B2 * 10/2008 Yamamoto ..... B60N 2/2809 280/801.1

(Continued)

OTHER PUBLICATIONS

Web page printout of Universal Fire Extinguisher Seat Mounts, H3R Performance; http://www.h3rperformance.com/seat_mounts.htm, Mar. 31, 2016, 2 pages.

*Primary Examiner* — Peter Helvey
(74) *Attorney, Agent, or Firm* — Cislo & Thomas, LLP

(57) ABSTRACT

A vehicle accessory support assembly for vehicles having a pair of opposed parallel seat rails, the vehicle accessory support assembly comprising a bar having a longitudinal axis, a first end portion and a second end portion, a first grip supported by the first end portion of the bar and configured to grip a first one of the pair of opposed parallel seat rails, a second grip slidably coupled to the second end portion of the bar and configured to grip a second one of the pair of opposed parallel seat rails and at least one support projecting from the bar, the support configured to support a vehicle accessory.

19 Claims, 5 Drawing Sheets

(56) References Cited

U.S. PATENT DOCUMENTS

| | | | | |
|---|---|---|---|---|
| 9,022,340 | B2 * | 5/2015 | McLeod | B60N 2/2887 248/500 |
| 9,114,766 | B1 * | 8/2015 | Pelini | B60R 11/04 |
| D750,958 | S | 3/2016 | Childs et al. | |
| 9,446,687 | B2 * | 9/2016 | Kamara | B60N 2/015 |
| 2002/0008416 | A1 * | 1/2002 | Deptolla | B60N 2/2827 297/250.1 |
| 2004/0080194 | A1 * | 4/2004 | Medvecky | B60N 2/2887 297/253 |
| 2012/0018471 | A1 * | 1/2012 | Guillermo | B60R 11/0235 224/275 |
| 2012/0125959 | A1 * | 5/2012 | Kucera | B60R 11/0235 224/275 |
| 2015/0041508 | A1 * | 2/2015 | Fan | B60R 11/02 224/275 |
| 2015/0115009 | A1 * | 4/2015 | Stauber | B60R 11/02 224/275 |

* cited by examiner

VEHICLE ACCESSORY SUPPORT ASSEMBLY

CROSS-REFERENCE TO RELATED APPLICATIONS

This application claims the benefit of U.S. Provisional Patent Application No. 62/144,836 titled "Vehicle Accessory Support Assembly," filed Apr. 8, 2015, the contents of which are incorporated herein by reference in their entirety.

BACKGROUND OF THE INVENTION

Many people have the desire to securely mount an accessory within their vehicles. For example, in the fields of automotive racing and emergency services, there is a need to securely mount fire extinguishers within vehicles in a place which is easy to reach in the event of an emergency. Even for an average user, there is a need to mount accessories such as a smartphone.

The two most common ways to mount such accessories within vehicles are by either using a model-specific mounting bracket or drilling holes through parts of the vehicle. Both of these options are undesirable because a user must either find the correct model-specific bracket to use in their vehicle, or they must permanently disfigure their vehicle. Model-specific brackets can be very expensive and difficult to find, and if the user were to change vehicles, they must find and purchase a new bracket specific to the make and model of the new vehicle. Permanently disfiguring a vehicle is also unfavorable because it can reduce both the structural integrity and the value of the vehicle, as well as require additional tools and skill on the part of the user to install the bracket.

As such, there is a need for a vehicle accessory support assembly which can be used on a wide variety of different vehicles, does not require inflicting any damage to the vehicle to mount, and is easy to install and operate.

The present invention overcomes several of the deficiencies, disadvantages and undesired parameters associated with the known vehicle accessory support assemblies.

SUMMARY OF THE INVENTION

According to one embodiment of the present invention, there is provided a vehicle accessory support assembly for use on any vehicle having a pair of opposed parallel seat rails after the vehicle has been initially sold by the manufacturer comprising a) a bar having a longitudinal axis, a first end portion, and a second end portion; b) a first grip comprising an engaging portion, the first grip slidably coupled to the first end portion of the bar and configured to grip a first one of the seat rails; c) a second grip comprising an engaging portion, the second grip slidably coupled to the second end portion of the bar and configured to grip a second one of the seat rails; and d) at least one support projecting from the bar, the support configured to support a vehicle accessory, wherein the vehicle accessory support assembly is reversibly mechanically coupled to the pair of opposed seat rails such that there is no alteration to the pair of opposed seat rails.

According to another embodiment of present invention, there is provided a method of using a vehicle accessory support assembly, wherein the method comprises the steps of: a) providing the vehicle accessory support assembly according to the present invention; b) placing the first and second grips over the pair of opposed parallel seat rails; c) adjusting the first and second grips to a correct width of the pair of opposed parallel seat rails; d) coupling the first and second grips to the pair of opposed seat rails, and e) coupling an accessory to the support.

DRAWINGS

These and other features, aspects and advantages of the present invention will become better understood with reference to the following description, appended claims, and accompanying drawings where:

DETAILED DESCRIPTION OF THE INVENTION

The following discussion describes in detail one embodiment of the present invention and several variations of that embodiment. This discussion should not be construed, however, as limiting the invention to those particular embodiments. Practitioners skilled in the art will recognize numerous other embodiments as well.

Definitions

As used herein, the following terms and variations thereof have the meanings given below, unless a different meaning is clearly intended by the contest in which such term is used.

The terms "a," "an," and "the" and similar referents used herein are to be construed to cover both the singular and the plural unless their usage in context indicates otherwise.

As used in this disclosure, the term "comprise" and variations of the term, such as "comprising" and "comprises," are not intended to exclude other additives, components, integers ingredients or steps.

The Invention

Figure 1:
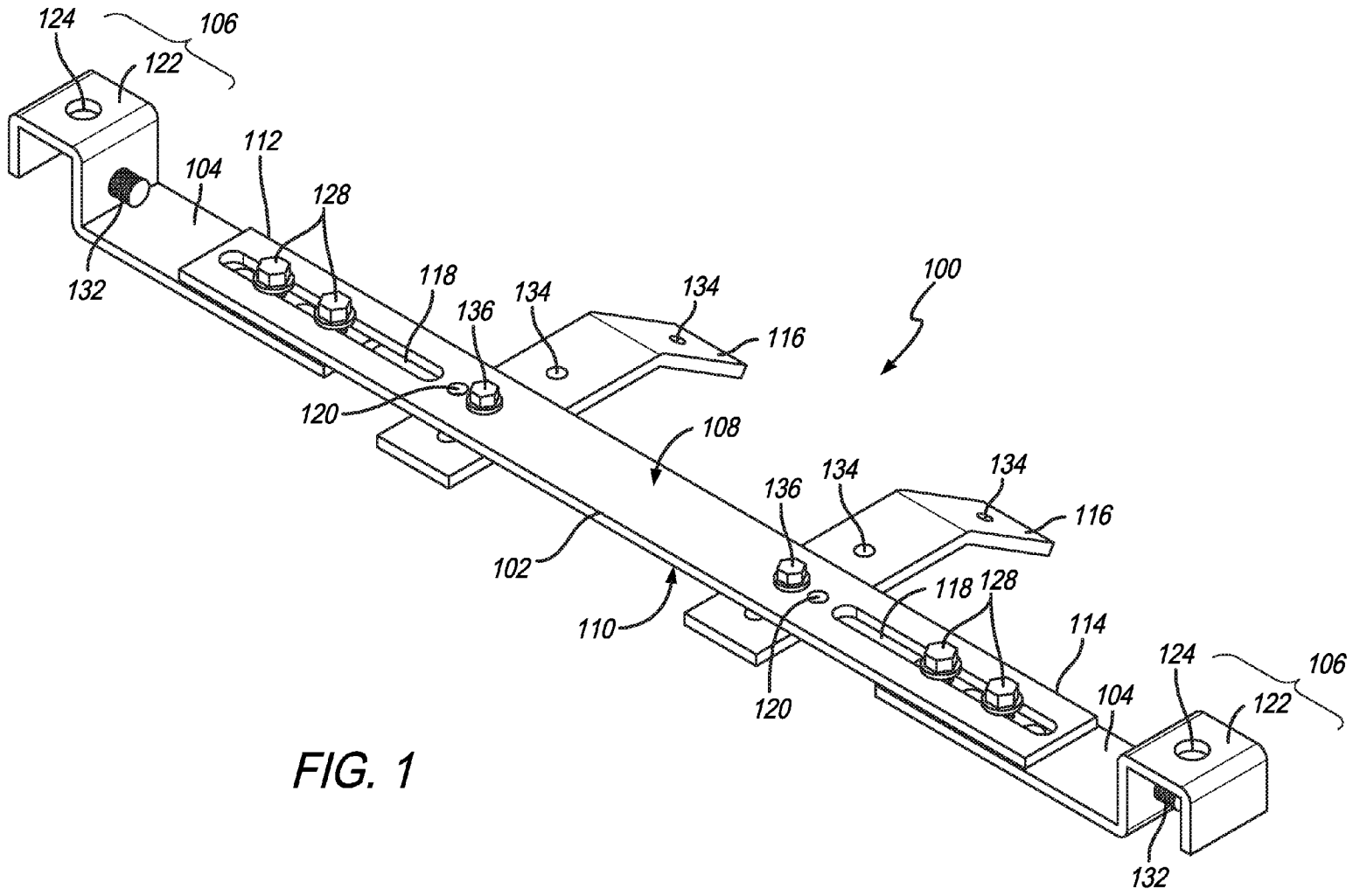
FIG. 1 is a perspective view of a vehicle accessory support assembly having features of the present invention.
Figure 6:
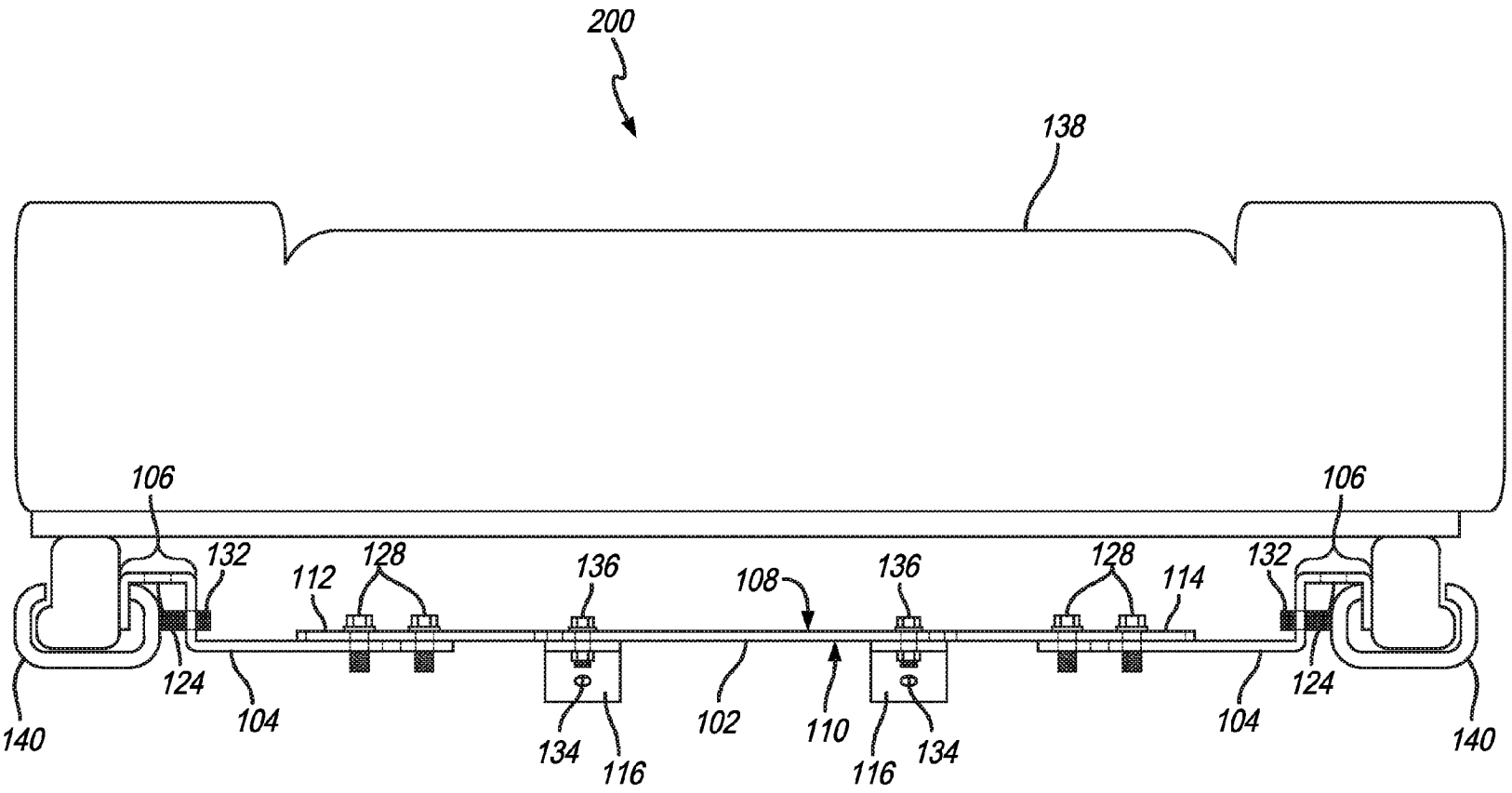
FIG. 6 is a front elevation view of the vehicle accessory support assembly of FIG. 1, mounted on a pair of parallel opposed seat rails.

Referring now to FIG. 1, a vehicle accessory support assembly 100 having features of the present invention that can support accessories within a vehicle is shown. FIG. 1 is a perspective view of the vehicle accessory support assembly 100 having features of the present invention. The vehicle accessory support assembly 100 comprises a bar 102 and a pair of grips 104, wherein each grip 104 has an engaging portion 106. The bar 102 extends between the pair of opposed parallel seat rails 140 (as shown in FIG. 6) and has a longitudinal axis, an upper surface 108, a lower surface 110, and opposed end portions 112, 114. The pair of grips 104 are located at the opposed end portions 112, 114 of the bar 102 and engage the pair of opposed parallel seat rails 140. An accessory (not shown) can be removably coupled to the bar 102 or the vehicle accessory support assembly 100 can further comprise one or more supports 116 which project from the bar 102 and removably support an accessory.

The vehicle accessory support assembly 100 can support any accessory a user may desire to mount within a vehicle. For example, a user may have the desire to mount a fire extinguisher to the vehicle accessory support assembly 100.

Additionally, a user could mount radio or audio equipment, performance-enhancing devices such as $NO_2$ or purge bottles, or even technical equipment as needed in emergency services vehicles. Any other accessory or device may be supported by the vehicle accessory support assembly 100. The vehicle accessory support assembly 100 can be used on any vehicle having a pair of opposed parallel seat rails 140, before or after the vehicle has been initially sold by the manufacturer.

Figure 2:
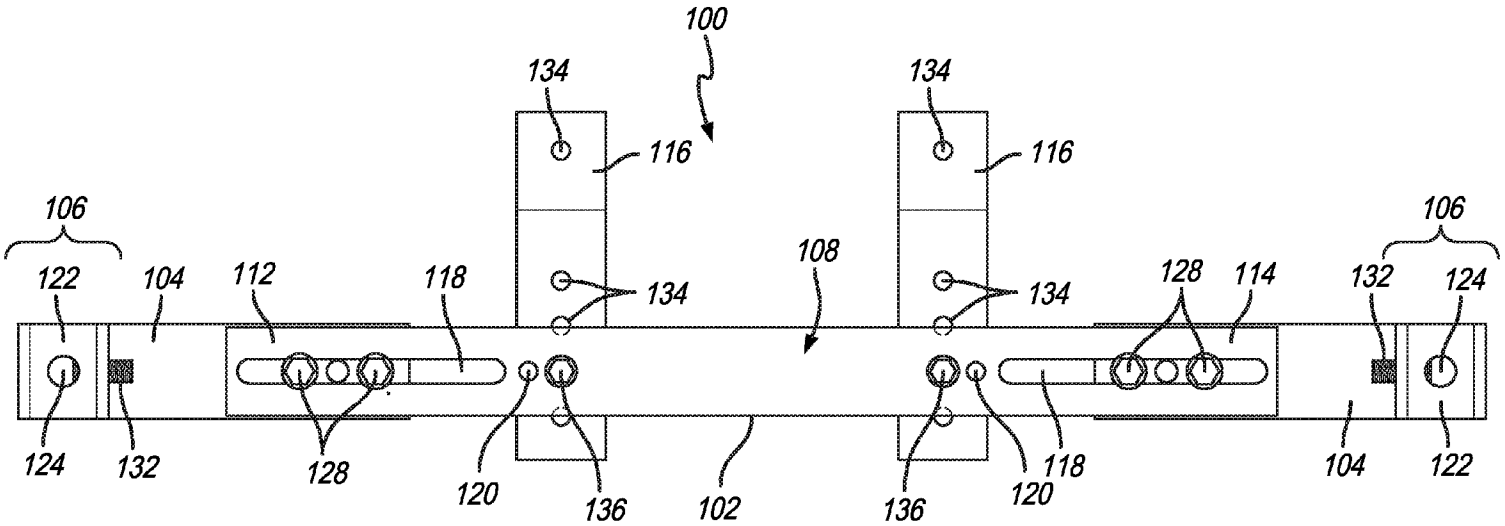
FIG. 2 is a top perspective view of the vehicle accessory support assembly of FIG. 1.
Figure 3:
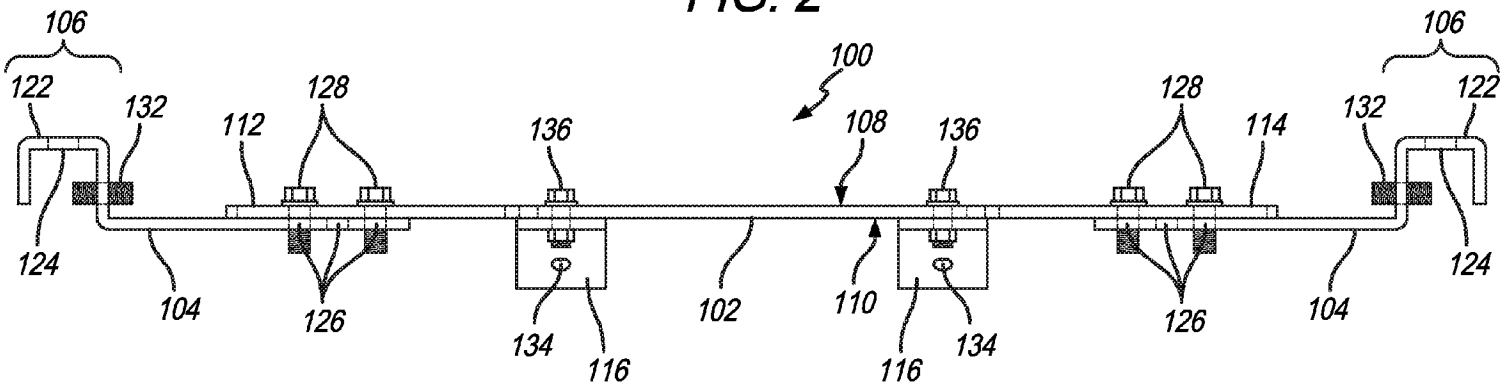
FIG. 3 is rear elevation view of the vehicle accessory support assembly of FIG. 1.
Figure 4:
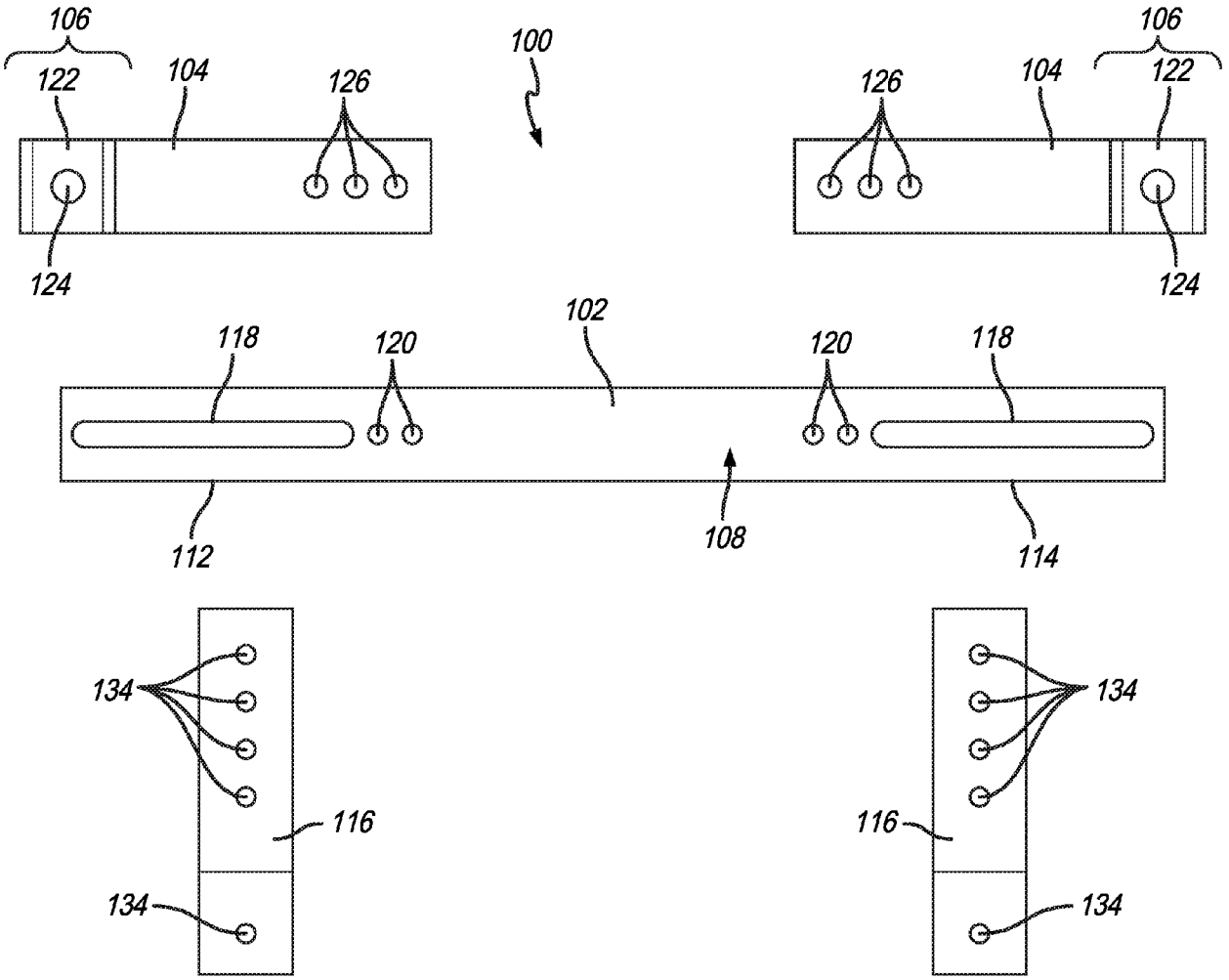
FIG. 4 is a top perspective view of the vehicle accessory support assembly of FIG. 1, disassembled.
Figure 5:
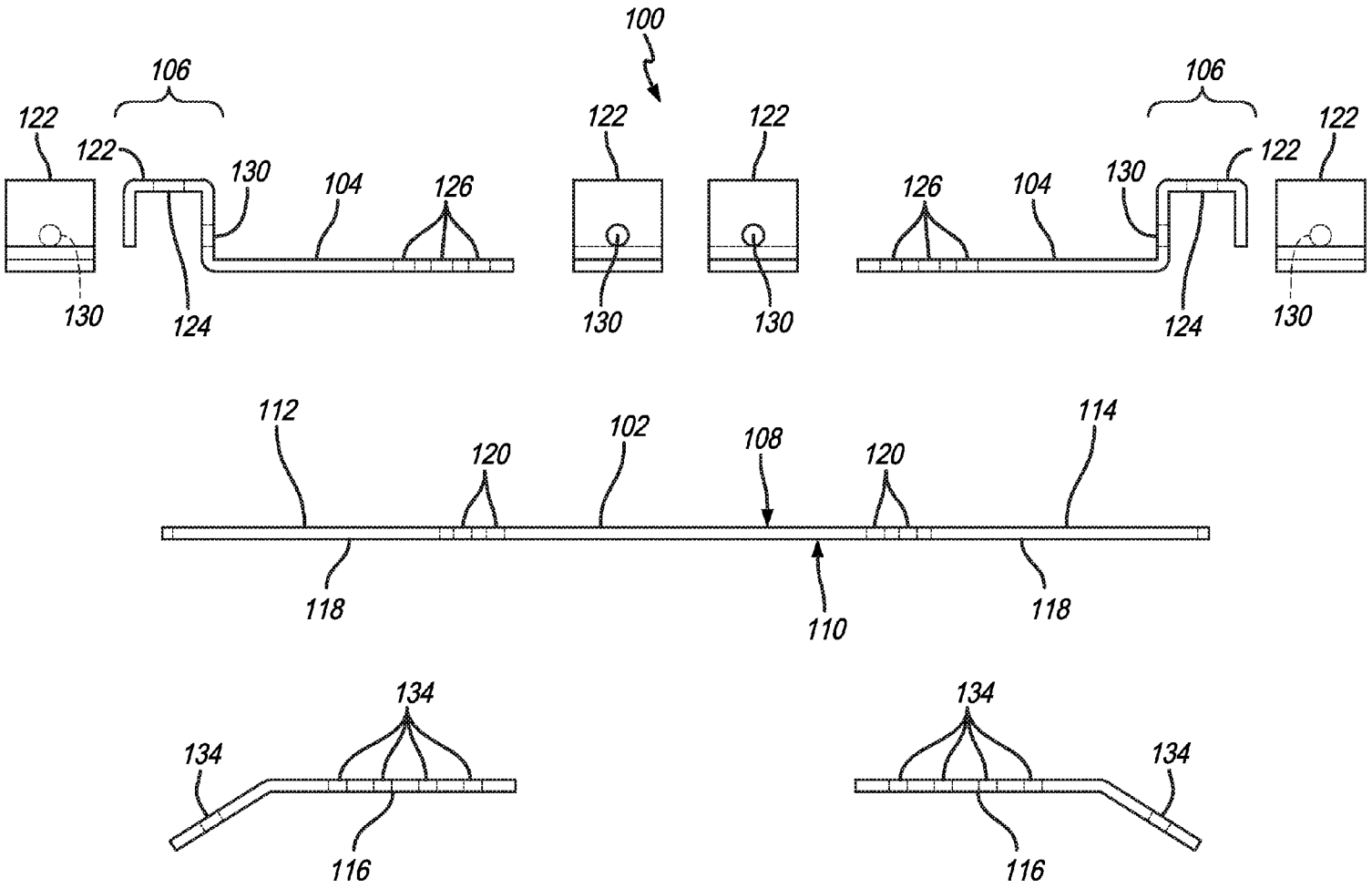
FIG. 5 is front elevation view of the vehicle accessory support assembly of FIG. 1, disassembled.

Referring now to FIGS. 2 through 4, FIG. 2 is a top perspective view of the vehicle accessory support assembly 100 of FIG. 1, FIG. 3 is a rear elevation view of the vehicle accessory support assembly 100 of FIG. 1, FIG. 4 is a top perspective view of the vehicle accessory support assembly 100 of FIG. 1, disassembled, and FIG. 5 is front elevation view of the vehicle accessory support assembly 100 of FIG. 1, disassembled.

The bar 102 can be made from any material, including but not limited to carbon fiber, plastic, fiberglass, wood, or metal, and the bar 102 can be solid or hollow. In one embodiment, the bar 102 is made from aluminum. In a preferred embodiment, the bar 102 is made from mild/low-carbon steel for strength. The cross-section of the bar 102 can be any shape, including but not limited to circular or C-shaped. Preferably the cross-section of the bar 102 is a rectangular shape. Additionally, the bar 102 can be any dimension, but preferably the bar 102 is between 8 and 14 inches long, between 0.5 to 2 inches wide and between 0.125 to 0.5 inches thick.

As best shown in FIGS. 2 and 4, the bar 102 can further comprise one or more slots 118 extending along a portion of the longitudinal axis of the bar 102. The slots 118 allow the grips 104, to be slidably coupled to the bar 102, permitting the vehicle accessory support assembly 100 to extend and contract, allowing it to adapt to different opposed parallel seat rail 140 configurations. The distance between a pair of opposed parallel seat rails 140 varies depending on the type of vehicle and the manufacturer. The sliding movement of the grips 104 along the bar 102 allows the vehicle accessory support assembly 100 to couple to a wide variety of different vehicles. The slots 118 can be any shape and dimension and can be located anywhere along the bar 102. Preferably the slots 118 are between 2 and 6 inches long and between 0.125 and 0.75 inches wide. Additionally, the bar 102 can further comprise one or more holes 120 to provide a means for the one or more supports 116 to couple to the bar 102.

The pair of grips 104 can be made from any material, including but not limited to carbon fiber, plastic, fiberglass, wood, or metal. Additionally, the pair of grips 104 can be solid or hollow. Preferably the pair of grips 104 is made from steel. The cross-section of the pair of grips 104 can be any shape, including but not limited to, circular or C-shaped. Preferably the cross-section of the pair of grips 104 is a rectangular shape.

As best shown in FIGS. 3 and 5, the pair of grips 104 can be any shape or dimension, but preferably are between 2 inches to 8 inches long. Additionally, the engaging portions 106 of the pair of grips 104 can be any shape or configuration, but preferably the engaging portions 106 of the pair of grips 104 are in the shape of a 'U' or 'C' such that they are placed over and engage the pair of opposed parallel seat rails 140 of the vehicle. The engaging portions 106 of the pair of grips 104 can be any dimension, but preferably the engaging portions are each between 0.25 inches to 2 inches wide. Additionally, the engaging portions 106 of the grips 104 can each comprise an upper surface 122, and the upper surface 122 of each engaging portion 106 can comprise one or more holes 124 disposed therein. ]

The engaging portions 106 of the grips 104 are designed such that no alteration or modification of the vehicle or vehicle seat rails 140 are necessary in order for a user to mount the vehicle accessory support assembly 100 in a vehicle. Alteration includes, among other things, drilling holes or fasteners into/through either the vehicle itself or the vehicle seat rails 140, or some other form of non-reversible alteration. This is not necessary with the vehicle accessory support assembly 100. The grips 104 grip the pair of opposed seat rails 140 without causing any damage to the seat rails 140, or requiring the user to alter or cause damage to the seat rails 140, either by drilling holes or some other form of permanent alteration.

The vehicle accessory support assembly 100 can be easily be installed and then removed after use, making it reversibly mechanically coupled to the pair of opposed seat rails 140. Once removed, it leaves no trace that it was ever installed in the vehicle. The vehicle accessory support assembly 100 is also advantageous because it can be mounted in any vehicle having a vehicle seat mounted on a pair of opposed seat rails 140. This means that when a user sells their vehicle, or drives a different vehicle for whatever reason, they can quickly and easily remove the vehicle accessory support assembly 100 from their current vehicle, and install it in the new vehicle without any alteration or modification necessary in the new vehicle.

The pair of grips 104 can be permanently or removably coupled to the bar 102. Preferably they are removably and slidably coupled to the bar 102. In order to couple the pair of grips 104 to the bar 102, each of the pair of grips 104 can comprise one or more holes 126 disposed along a portion of the longitudinal axis of the grip 104. The one or more holes 126 can be any dimension but preferably are between 0.25 and 0.5 inches in diameter. The one or more holes 126 enable the pair of grips 104 to be coupled to the bar 102 by a first pair of fasteners 128. The first pair of fasteners 128 can include but are not limited to screws, bolts, nuts, and rivets. Preferably the first pair of fasteners 128 are socket cap screws. The first pair of fasteners 128 are coupled to the one or more holes 126 along the pair of grips 104, and extend through the slots 118 in the bar 102. This configuration allows the grips 104 (and first pair of fasteners 128) to slide along the slots 118 to the desired position prior to tightening. Once the desired position has been achieved, the first pair of fasteners 128 are tightened, fastening the grips 104 to the bar 102.

Additionally, the pair of grips 104 can each comprise an opening 130 (best shown in FIG. 5) and the vehicle accessory support assembly 100 can further comprise a second pair of fasteners 132. The openings 130 can be any dimension but preferably are between 0.25 and 0.75 inches in diameter. The second pair of fasteners 132 are inserted through the openings 130 of the grips 104 and fasten the pair of grips 104 to the pair of opposed parallel seat rails 140. The second pair of fasteners 132 can comprise any means of fastening the grips 104 to the pair of opposed parallel seat rails 140, including but not limited to screws, bolts, nuts, and rivets. Preferably the second pair of fasteners 132 comprise grub screws. The second pair of fasteners 132 allow the grips 104 to be securely and removably fastened to the pair of opposed parallel seat rails 140 of the vehicle without the need for the user to drill holes into the vehicle to secure the vehicle accessory support assembly 100.

The one or more supports 116 extend out from the bar 102 and provide a location for the accessory to be removably mounted. The one or more supports 116 can be coupled to any surface of the bar 102, including but not limited to the upper surface 108 or the lower surface 110 of the bar 102. The one or more supports 116 can extend in any direction from the bar 102 depending on the mounting location desired by the user. The one or more supports 116 each have two opposed ends and can be any dimension, but preferably are between 2 inches and 12 inches long and between 0.5 inches and 6 inches wide. The one or more supports 116 can be made from any material, including but not limited to carbon fiber, plastic, wood, or metal, and the one or more supports 116 can be solid or hollow. Preferably the one or more supports 116 are made from aluminum. The cross-section of the one or more supports 116 can be any shape, including but not limited to circular or C-shaped, but preferably the cross-section of the one or more supports 116 is a rectangular shape.

Additionally, the one or more supports 116 can have one or more support holes 134 located along the longitudinal axis of the one or more supports 116 to provide multiple positions for mounting to the supports 116 to the bar 102 and for mounting the accessory to the supports 116. The support holes 134 can be any size and dimension, but preferably are between 0.2 and 0.5 inches in diameter. Optionally, as best shown in FIGS. 1, 3, 5 and 6, one of the opposed ends of the one or more supports 116 can be at an angle relative to the longitudinal axis of the support 116, which provides even greater options for mounting the accessory to the vehicle. Additionally, both of the opposed ends of the supports 116 could be at an angle relative to the longitudinal axis of the support 116.

The one or more support holes 134 enable the one or more supports 116 to be coupled to the bar 102 by a third pair of fasteners 136. The third pair of fasteners 136 can include but are not limited to screws, bolts, nuts, and rivets. Preferably the third pair of fasteners 136 are socket cap screws.

Moreover, one or more spacers (not shown) can be inserted between the supports 116 and the bar 102 to provide the user with greater ability to raise or lower the mounting position of the accessory. Optionally the spacers can comprise washers.

As can be seen in FIG. 6, the vehicle accessory support assembly 100 engages a pair of opposed parallel seat rails 140. Vehicle seats 138 are typically mounted on a pair of opposed parallel seat rails 140 which are coupled to the frame of the vehicle (not shown). The pair of opposed parallel seat rails 140 typically allow the vehicle seats 138 to move forward or backward in order to accommodate drivers of different sizes. The vehicle accessory support assembly 100 can engage a pair of opposed parallel seat rails 140 located below a vehicle seat 138, at either the front, the rear, or underneath the vehicle seat 138.

A method of using a vehicle accessory support assembly 100 on any vehicle having a pair of opposed parallel seat rails 140 after the vehicle has been initially sold by the manufacturer, the method comprising the steps of placing the engaging portions 106 of the pair of grips 104 over the pair of opposed parallel seat rails 140, adjusting the pair of grips 104 to a correct width of the pair of opposed parallel seat rails 140, coupling the pair of grips 104 to the pair of opposed parallel seat rails 140 using the second pair of fasteners 132, and coupling an accessory to the one or more supports 116 extending from the bar 102.

Another method of securing the vehicle accessory support assembly 100 on any vehicle having a pair of opposed parallel seat rails 140 after the vehicle has been initially sold by the manufacturer comprises the steps of: a) removing the two or more bolts (not shown) that secure a pair of opposed seat rails 140 to the vehicle, revealing two or more holes in the pair of opposed seat rails 140; b) inverting the vehicle accessory support assembly 100; c) aligning the one or more holes 124 disposed in the upper surface 122 of the engaging portion 106 with the two or more holes in the pair of opposed seat rails 140; and d) inserting the two bolts that were previously removed through the one or more holes 124 disposed in the upper surface 122 of the engaging portion 106 and the two or more holes in the pair of opposed seat rails 140, thereby securing the vehicle accessory support assembly 100 to the pair of opposed seat rails 140.

Although the present invention has been described in considerable detail with reference to certain preferred embodiments, other embodiments are possible. The steps disclosed for the present methods, for example, are not intended to be limiting nor are they intended to indicate that each step is necessarily essential to the method, but instead are exemplary steps only. Therefore, the scope of the appended claims should not be limited to the description of preferred embodiments contained in this disclosure. All references cited herein are incorporated by reference in their entirety.

What is claimed is:

1. A vehicle accessory support assembly for use on any vehicle having a pair of opposed parallel seat rails after the vehicle has been initially sold by the manufacturer, the vehicle accessory support assembly comprising:

a) a bar having a longitudinal axis, a first end portion, a second end portion, and one or more slots extending along a portion of the longitudinal axis of the bar;

b) a first grip comprising a first engaging portion, the first grip slidably coupled to the first end portion of the bar and configured to grip a first one of the pair of opposed seat rails;

c) a first opening disposed in the first engaging portion;

d) a second grip comprising a second engaging portion, the second grip slidably coupled to the second end portion of the bar and configured to grip a second one of the pair of opposed seat rails;

e) a second opening disposed in the second engaging portion;

f) a first pair of fasteners configured to couple the first grip to the first end portion of the bar and the second grip to the second end portion of the bar via the one or more slots in the bar;

g) a second pair of fasteners configured to couple the first and second grips to the first and second seat rails, wherein a first fastener of the second pair of fasteners is inserted through the first opening of the first engaging portion to couple the first grip to the first seat rail and a second fastener of the second pair of fasteners is inserted through the second opening of the second engaging portion to couple the second grip to the second seat rail; and h) at least one support projecting from the bar, the support configured to support a vehicle accessory;

wherein the vehicle accessory support assembly is reversibly mechanically coupled to the pair of opposed seat rails such that there is no alteration to the pair of opposed seat rails.

2. The vehicle accessory support assembly of claim 1, wherein the first and second grip each comprise a longitudinal axis, and further comprise one or more holes disposed along a portion of their longitudinal axes.

3. The vehicle accessory support assembly of claim 1, wherein the second pair of fasteners comprise grub screws.

4. The vehicle accessory support assembly of claim 1, further comprising a second support projecting from the bar, the second support configured to support the vehicle accessory.

5. The vehicle accessory support assembly of claim 4, further comprising a third pair of fasteners configured to couple the first and second supports to the bar.

6. A vehicle accessory support assembly for use on any vehicle having a pair of opposed parallel seat rails after the vehicle has been initially sold by the manufacturer, the vehicle accessory support assembly comprising:

a) a bar having a longitudinal axis, a first end portion, and a second end portion;

b) a first grip comprising an engaging portion, the first grip slidably coupled to the first end portion of the bar and configured to grip a first one of the seat rails;

c) a second grip comprising an engaging portion, the second grip slidably coupled to the second end portion of the bar and configured to grip a second one of the seat rails; and d) at least one support projecting from the bar, the support configured to support a vehicle accessory;

wherein the vehicle accessory support assembly is reversibly mechanically coupled to the pair of opposed seat rails such that there is no alteration to the pair of opposed seat rails.

7. The vehicle accessory support assembly of claim 6, wherein the bar comprises one or more slots extending along a portion of the longitudinal axis of the bar and a first pair of fasteners configured to couple the first grip to the first end portion of the bar and the second grip to the second end portion of the bar via the one or more slots.

8. The vehicle accessory support assembly of claim 6, wherein the first engaging portion of the first grip comprises a first opening and the second engaging portion of the second grip comprises a second opening.

9. The vehicle accessory support assembly of claim 8, further comprising a second pair of fasteners configured to couple the first and second grips to the first and second seat rails, wherein a first fastener of the second pair of fasteners is inserted through the first opening of the first engaging portion to couple the first grip to the first seat rail and a second fastener of the second pair of fasteners is inserted through the second opening of the second engaging portion to couple the second grip to the second seat rail.

10. The vehicle accessory support assembly of claim 9, wherein the second pair of fasteners comprise grub screws.

11. The vehicle accessory support assembly of claim 6, further comprising a second support projecting from the bar, the second support configured to support the vehicle accessory.

12. The vehicle accessory support assembly of claim 11, further comprising a third pair of fasteners configured to couple the first and second supports to the bar.

13. A method of using a vehicle accessory support assembly on any vehicle having a pair of opposed parallel seat rails after the vehicle has been initially sold by the manufacturer, the method comprising the steps of:

a) providing a vehicle accessory support assembly, the vehicle accessory support assembly comprising:

i) a bar having a longitudinal axis, a first end portion, and a second end portion;

ii) a first grip comprising an engaging portion, the first grip slidably coupled to the first end portion of the bar and configured to grip a first one of the pair of opposed seat rails;

iii) a second grip comprising an engaging portion, the second grip slidably coupled to the second end portion of the bar and configured to grip a second one of the pair of opposed seat rails; and iv) at least one support projecting from the bar, the support configured to support a vehicle accessory;

wherein the vehicle accessory support assembly is reversibly mechanically coupled to the pair of opposed seat rails such that there is no alteration to the pair of opposed seat rails;

b) placing the first and second grips over the pair of opposed parallel seat rails;

c) adjusting the first and second grips to a correct width of the pair of opposed parallel seat rails;

d) coupling the first and second grips to the pair of opposed seat rails; and e) coupling an accessory to the support.

14. The method of claim 13, wherein the vehicle accessory support assembly comprises a first pair of fasteners configured to couple the first grip to the first end portion of the bar and the second grip to the second end portion of the bar.

15. A method of using the vehicle accessory support assembly of claim 1, the method comprising the steps of:

a) placing the first and second grips over the pair of opposed parallel seat rails;

b) adjusting the first and second grips to a correct width of the pair of opposed parallel seat rails;

c) coupling the first and second grips to the pair of opposed seat rails; and d) coupling an accessory to the support.

16. The method of claim 15, wherein the first and second grips each comprise a longitudinal axis, and further comprise one or more holes disposed along a portion of their longitudinal axes.

17. The method of claim 15, wherein the second pair of fasteners comprise grub screws.

18. The method of claim 15, wherein the vehicle accessory support assembly comprises a second support projecting from the bar and the second support is configured to support the vehicle accessory.

19. The method of claim 18, wherein the vehicle accessory support assembly comprises a third pair of fasteners configured to couple the first and second supports to the bar.

* * * * *